US008281540B2

(12) United States Patent
Strickland et al.

(10) Patent No.: US 8,281,540 B2
(45) Date of Patent: Oct. 9, 2012

(54) UNITARY STEEL JOIST

(75) Inventors: Michael Richard Strickland, Richmond Hill (CA); Douglas M. Fox, Kitchener (CA); Richard Wilson Strickland, Richmond Hill (CA)

(73) Assignee: iSpan Systems LP, Princeton, Ontario (CA)

( * ) Notice: Subject to any disclaimer, the term of this patent is extended or adjusted under 35 U.S.C. 154(b) by 0 days.

(21) Appl. No.: 12/942,714

(22) Filed: Nov. 9, 2010

(65) Prior Publication Data

US 2011/0162319 A1 Jul. 7, 2011

Related U.S. Application Data

(60) Provisional application No. 61/272,830, filed on Nov. 9, 2009.

(51) Int. Cl.

| | |
|---|---|
| ***E04B 1/18*** | (2006.01) |
| ***E04B 5/10*** | (2006.01) |
| ***E04B 5/18*** | (2006.01) |
| ***E04C 3/02*** | (2006.01) |

(52) U.S. Cl. ..... 52/634; 52/650.1; 52/690; 52/842; 52/636

(58) Field of Classification Search ..... 52/636, 52/634, 650.1, 690, 693, 695, 696, 837, 838, 52/842, 846

See application file for complete search history.

(56) References Cited

U.S. PATENT DOCUMENTS

| | | | | |
|---|---|---|---|---|
| 1,735,590 | A * | 11/1929 | White | 52/695 |
| 5,546,716 | A * | 8/1996 | Broxterman et al. | 52/220.1 |
| 5,560,177 | A * | 10/1996 | Brightwell | 52/841 |
| 6,708,459 | B2 | 3/2004 | Bodnrar | |
| 6,761,005 | B1 * | 7/2004 | Daudet et al. | 52/272 |
| 6,807,787 | B1 * | 10/2004 | Ross | 52/586.1 |
| 7,127,862 | B2 * | 10/2006 | Saldana | 52/715 |
| 7,451,575 | B2 * | 11/2008 | Hall et al. | 52/289 |
| 7,587,877 | B2 * | 9/2009 | Strickland et al. | 52/837 |
| 7,765,771 | B2 * | 8/2010 | Serpico et al. | 52/846 |
| 2002/0005022 | A1 * | 1/2002 | Matthews | 52/483.1 |
| 2002/0078645 | A1 * | 6/2002 | Meyer | 52/289 |
| 2009/0205285 | A1 * | 8/2009 | Jendusa | 52/650.3 |

FOREIGN PATENT DOCUMENTS

| | | | |
|---|---|---|---|
| CA | 2455071 | A1 | 5/2005 |
| WO | 2005042869 | A1 | 5/2005 |

OTHER PUBLICATIONS

International Search Report, International Application No. PCT/CA2010/001750, dated Feb. 21, 2011; completed Feb. 10, 2011.

* cited by examiner

*Primary Examiner* — Brian Glessner
*Assistant Examiner* — Adriana Figueroa
(74) *Attorney, Agent, or Firm* — Hill & Schumacher

(57) ABSTRACT

A unitary steel joist includes a generally vertical web, a generally horizontal bottom flange, a generally horizontal top flange, a bottom wing, a bottom web portion, a top wing and a top web portion. The generally horizontal bottom flange extends outwardly on each side of the web. The bottom flange is made of two pieces of steel. The generally horizontal top flange extends outwardly on each side of the web. The top flange is made of two pieces of steel. The bottom wing extends outwardly from the web. The bottom web portion extends between the bottom flange and bottom wing. The top wing extends outwardly from the web. The top web portion extends between the top flange and the top wing. The unitary steel joist is made from a unitary piece of steel.

27 Claims, 18 Drawing Sheets

UNITARY STEEL JOIST

CROSS REFERENCE TO RELATED U.S. PATENT APPLICATION

This patent application relates to, and claims the priority benefit from, U.S. Provisional Patent Application Ser. No. 61/272,830 filed on Nov. 9, 2009, which is incorporated herein by reference in its entirety.

FIELD OF THE INVENTION

This invention relates to steel joist and in particular steel cold rolled steel joist constructed from a unitary piece of steel with stiffening wings and snap-in-place bridging.

BACKGROUND OF THE INVENTION

In the past many innovative joist solutions have been created to improve the performance of floor joists for residential buildings.

Today house framing in North America is predominantly wood construction. The wood industry provides an I-Wood section that has the predominant market share in North America. The I-Wood joist is typically comprised of solid wood chord members that are adhered to a web that is a laminated chip board type member. Wood joists have a cost advantage over steel because the installation price for wood is less than steel. When housing construction is slow in North America the price for wood products goes very low, so it becomes very hard for steel to compete with wood for non rated floors based on cost.

Steel floor joist construction is gaining popularity now, the Light Steel Frame (LSF) industry has spent the last several years training framers, engineers, architects and contractors about steel framing. Today the market is predominantly cost based; owners and contractors typically build the cheapest way possible. For steel there have been many innovations improving the method of installation and the provision for follow up trades based on using various C-Shape designs. Although there have been considerable improvements, the use of steel joists has not reached a point wherein they are considered a mainstream method for building. In North America I-Wood joists have predominant market share in the framing market because the site laborers are typically trained for building with wood and because the required tools are on hand. For steel joists Standardized Connectors and Snap-in bridging assist with simplifying installation so that steel can be more competitive with wood. Where I-Wood is most competitive, at spans 16 ft and less for non rated floors, up until the present invention steel beam options have not presented cost efficient alternatives.

For fire and acoustic rated floors, I-Wood joists do not perform as well as solid wood joists or steel joists in certain situations. I-Wood joists face increasing criticism from Fire Officials in North America because installed joists have not performed well under real fire conditions. These I-Wood joist floors have caused injuries, and sometimes fatalities to fire fighters in North America every year where they have fallen through the floors when the joists have failed without warning during a fire. This faulty performance has resulted in calls from Fire Officials to sanction the I-Wood joists or improve their structural performance in fire. As can be seen in the FIG. 1 showing a chart titled 'Compare Results of ULC-S101 (Full-Scale Fire Resistance Tests), the I-Shaped steel joists (sold under the trademark iSpan™) outperformed the I-Wood joists in these fire tests. This better performance is significant to Fire Officials since the failure mode of the I-Shaped steel joist is typical of what they have experienced with solid wood joists in the past. FIG. 2 shows the structural members that were compared. Specifically (a) shows the I-wood joist; (b) the C-shaped steel joist; (c) the I-shaped steel joist sold under the trademark iSpan™; and (d) the solid wood joist. Note in the chart the rapid failure to carry load for the tested I-Wood joist and the more gradual failure of the tested I-Shaped steel joist.

Accordingly, an I-Shaped steel joist that performs well in a fire and is cost competitive would be advantageous for competing in short span wood applications.

SUMMARY OF THE INVENTION

The present invention relates to a unitary steel joist unitary steel joist comprising:

a generally vertical web;

a generally horizontal bottom flange extending outwardly on each side of the web, the bottom flange being made of two pieces of steel;

a generally horizontal top flange extending outwardly on each side of the web, the top flange being made of two pieces of steel;

a bottom wing extending outwardly from the web;

a bottom web portion extending between the bottom flange and the bottom wing;

a top wing extending outwardly from the web;

a top web portion extending between the top flange and the top wing;

and whereby the unitary steel joist being made from a unitary piece of steel.

The bottom wing and the top wing may be on the same side of the web.

The bottom wing and the top wing may be on opposite sides of the web.

The web may further include a plurality of utility holes formed therein. Each utility hole may have a lip around the perimeter thereof.

The unitary steel joist may further include a plurality of stitching holes formed in the web.

The plurality of stitching holes may be positioned in one of:

the web between the bottom flange and the bottom wing and wherein the stitching holes also extend through the bottom web portion;

the web between the top flange and the top wing and wherein the stitching holes also extend through the top web portion; and a combination thereof.

According to one aspect of the invention, one of the bottom wing and the top wing may further include a plurality of holes formed therein.

According to another aspect of the invention, both the top wing and the bottom wing may further include a plurality of holes formed therein.

The unitary steel joist may be a first steel joist and further include a plurality of steel joists to form a steel floor. The unitary steel joist may further include snap-in-place bridging and the snap-in-place bridging may be adapted to engage the holes in the wings and adapted to be positioned between adjacent unitary steel joists.

The snap-in-place bridging may have a generally triangular face, a generally horizontal edge portion on one side thereof, an angled edge portion on another side thereof and a generally vertical portion on the third side thereof. The snap-in-place bridging may include a first generally horizontal piece and an angled piece. The generally horizontal piece may extend between two adjacent unitary steel joists and engage the holes formed in the upper wings of the adjacent unitary steel joists. Further, the generally horizontal piece may also include a plurality of holes formed therein and the angled piece may engage the holes in the generally horizontal piece on one side thereof and engage the holes in the wings of the unitary steel joist on the other side thereof.

Each web of the unitary steel joist may include a plurality of holes in the bottom and the top thereof proximate to the upper and lower wings and one side of the generally horizontal piece may engage the holes in the web and the other side may engage the holes in the wings. The generally horizontal piece may further include a plurality of holes formed therein and the angled piece may engage the holes in the generally horizontal piece on one side thereof and engage the holes in the web of the unitary steel joist on the other side thereof.

In another embodiment, the unitary steel joist may be a first steel joist and further include a plurality of steel joists to form a steel floor, where the unitary steel joist may further include bridging members wherein each bridging member may be adapted to be received in the stitching holes and to span between adjacent unitary steel joists.

Each bridging member may include through tab adapted to extend through the stitching hole. Each bridging member may further include one of side tabs, upper tab and a combination thereof. The unitary steel joist may further include a unistrut pipe hanger attached to the bridging member. The bridging member may be an upper bridging member and may further include a lower bridging member attached between adjacent unitary steel joists and spaced downwardly from the upper bridging member. The unitary steel joist may further include at least one partial blocking panel extending between the upper and lower bridging members. The bridging member may include a full blocking panel. The full blocking panel may have a utility hole formed therein. The unitary steel joist may further include squash blocking.

Further features of the invention will be described or will become apparent in the course of the following detailed description.

BRIEF DESCRIPTION OF THE DRAWINGS

The invention will now be described by way of example only, with reference to the accompanying drawings, in which.

DETAILED DESCRIPTION OF THE INVENTION

Generally speaking, the systems described herein are directed to unitary steel joists. As required, embodiments of the present invention are disclosed herein. However, the disclosed embodiments are merely exemplary, and it should be understood that the invention may be embodied in many various and alternative forms.

The Figures are not to scale and some features may be exaggerated or minimized to show details of particular elements while related elements may have been eliminated to prevent obscuring novel aspects. Therefore, specific structural and functional details disclosed herein are not to be interpreted as limiting but merely as a basis for the claims and as a representative basis for teaching one skilled in the art to variously employ the present invention. For purposes of teaching and not limitation, the illustrated embodiments are directed to unitary steel joists.

Figure 1:
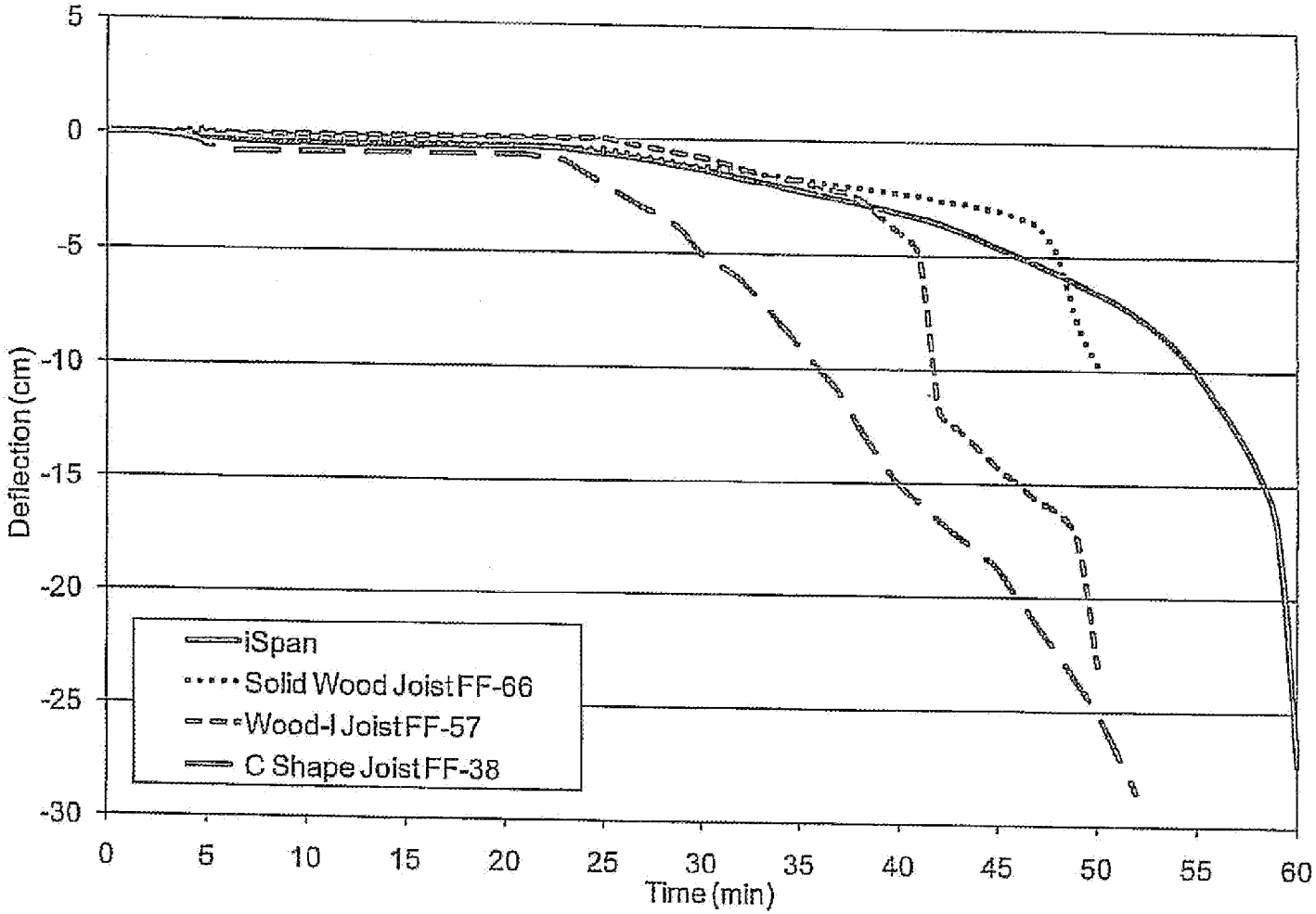
FIG. 1 is a chart comparing results of S101 tests using 1 Layer of Gypsum with the test results noted "FF" taken from NRCC Research Report #184 dated 2005 and the I-Shaped Steel data taken from ULC-S101 test conducted in 2005.
Figure 2:
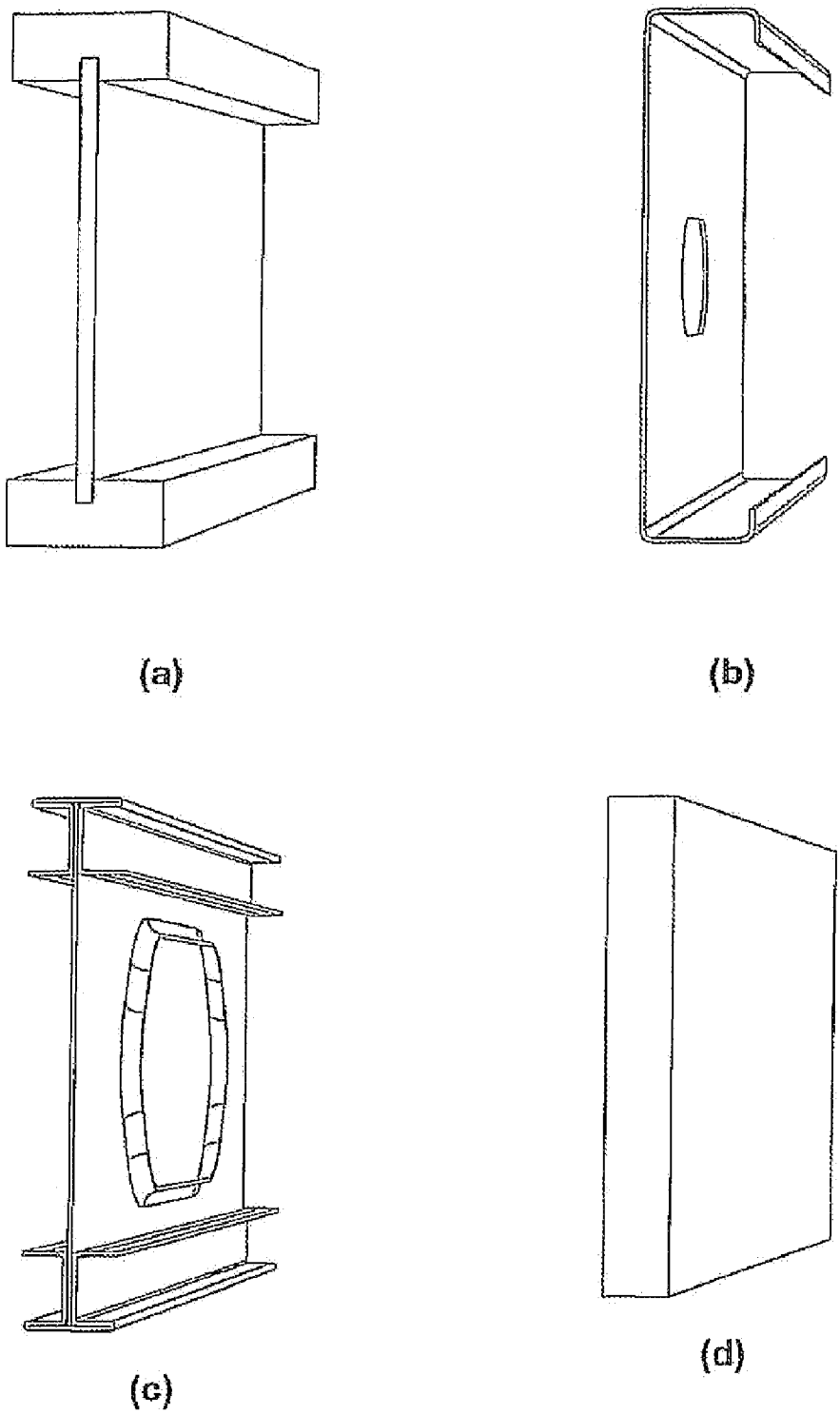
FIG. 2 (*a*) to (*d*) are perspective view of prior art floor joists wherein (a) is an I-wood joist; (b) is a C-shaped steel joist; (c) is an I-shaped steel joist; and (d) is a solid wood joist.
Figure 3:
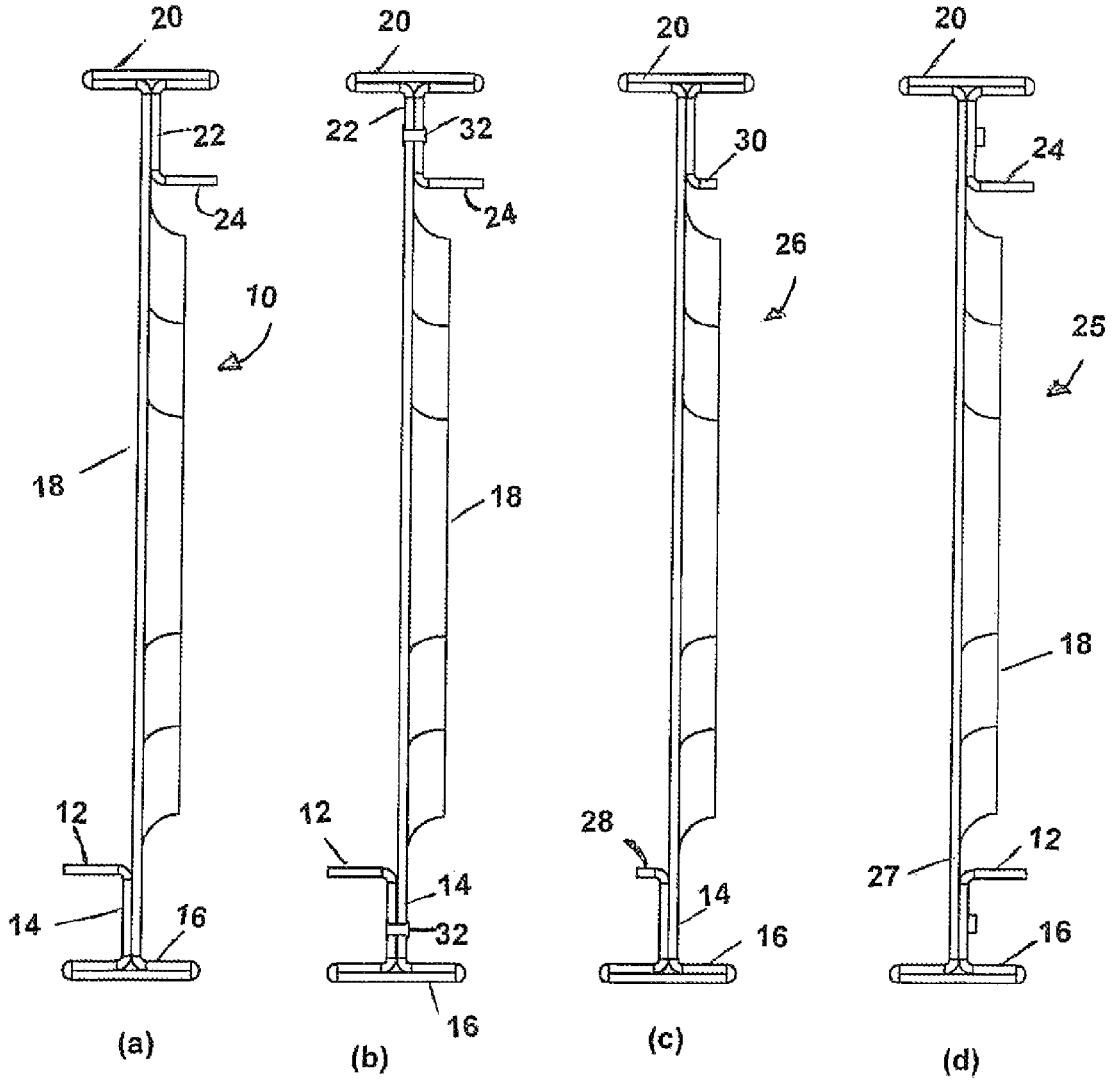
FIG. 3 (*a*) to (*d*) are perspective views of four alternate embodiments of the unitary joist of the present invention wherein (a) shows one embodiment; (b) shows an embodiment similar to (a) but with an alternate fastener; (c) shows an embodiment similar to (a) but with truncated wings; and (d) shows an embodiment similar to (a) but showing the top wing and the lower wing on the same side of the web.

FIG. 3 (*a*), (*b*), (*c*) and (*d*) show four alternate embodiments of the unitary joist of the present invention. Unitary joist 10 is constructed from a unitary piece of steel and is cold rolled into the shape shown herein.

The unitary joist 10 includes a lower wing 12, a lower web portion 14, a lower flange 16, a web 18, an upper flange 20, an upper web portion 22 and an upper wing 24. The lower wing 12 extends outwardly from the web 18. The lower web portion 14 extends generally downwardly from the lower wing 12 and is generally parallel to and adjacent to the web 18. The lower flange 16 is generally orthogonal to the web 18 and has a double thickness. Similarly, in one embodiment the upper wing 24 extends outwardly from the web 18 on the opposite side thereof from the lower wing 12. The upper web portion 22 extends generally upwardly from the upper wing 24 and is generally parallel to and adjacent to the web 18. In another embodiment, as shown in FIG. 3 (*d*) at 25 the upper wing 24 extends outwardly from the web on the same side as the lower wing 12.

Unitary joist 25 offers and alternative wherein the web 18 has a face that is unobstructed. This allows for the attachment of connectors, squash blocks and stiffeners on the unobstructed face 27 of the web 18. Preferably the utility holes and their stiffening and the stitching connectors are on the opposite side from the unobstructed face 27 of the web 18.

The size of the wings 12 and 24 may vary. As shown in FIG. 3 (*c*) unitary joist 26 may include truncated lower wing 28 and upper wing 30. Further, as shown in FIG. 3(*b*) the lower web portion 14 and the upper web portion 22 are each fastened 32 to the web by way of welding, spot welds, screws, rivets, clinching, stitching.

Figure 4:
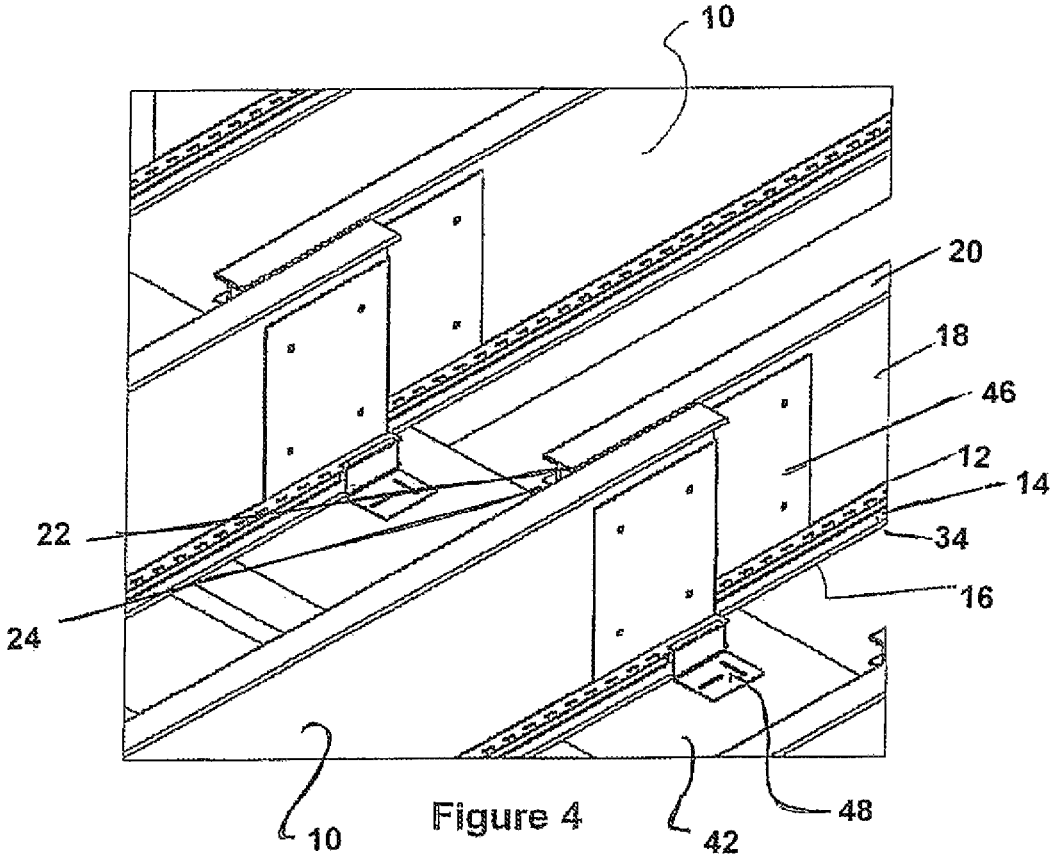
FIG. 4 is a perspective view of an embodiment of the unitary steel joist of the present invention over centre supports.
Figure 9:
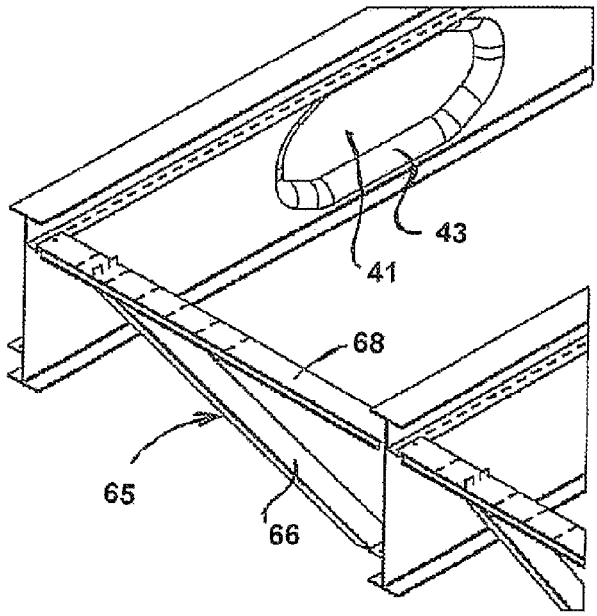
FIG. 9 is a perspective view of the adjustable snap-in-place bridging of FIG. 8 in situ.
Figure 11:
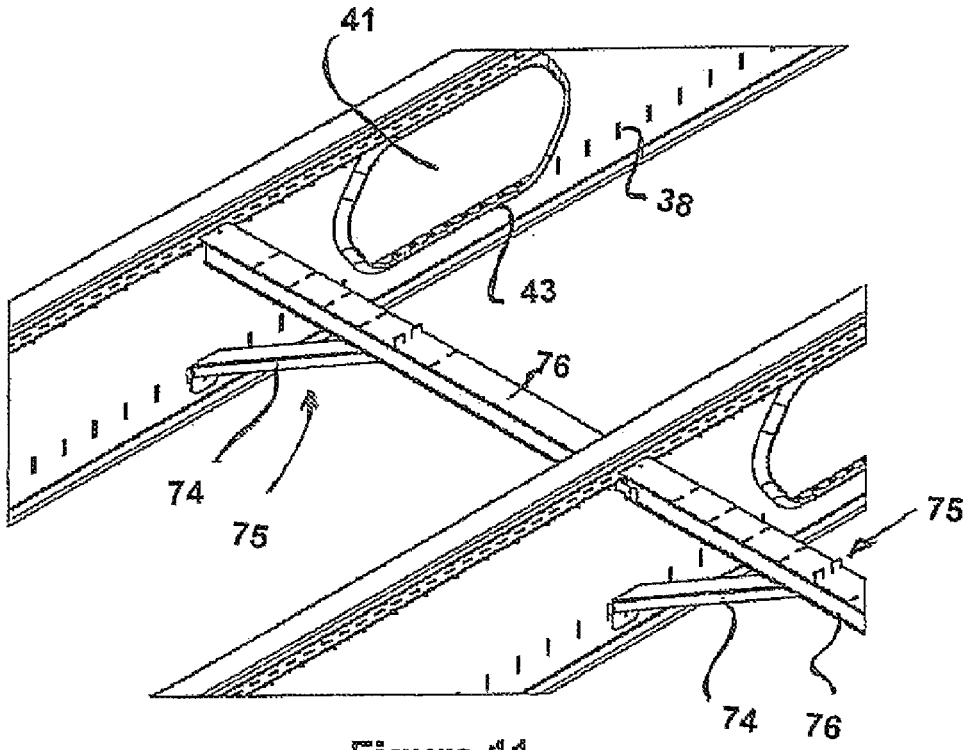
FIG. 11 is a perspective view of the adjustable snap-in-place bridging of FIG. 10 in situ.

Preferably upper wings 24 and lower wings 12 have a plurality of holes 34 formed therein as best seen in FIGS. 4 and 9. Holes 34 may be in the shape of slots as shown herein, however they may also have other shapes. Holes 34 are adapted to receive snap-in-place bridging 40 or other accessories that may also be snapped into place. In addition the web 18 may have a plurality of holes 38 formed therein as shown in FIG. 11 which are adapted to receive an alternate embodiment of snap-in-place bridging 75. Holes 38 are formed in the top and the bottom of the web 18 proximate to the upper 24 and lower 12 wings.

Web 18 may be provided with a plurality of utility holes 41 as shown in FIGS. 7, 9 11, and 12. Utility hole 41 has a lip 43 around the perimeter thereof that extends outwardly. Utility hole 41 allows for easy passage of pipes, wires and other cables. Lip 43 serves to reinforce the web.

It will be appreciated by those skilled in the art that the upper 12 and lower 24 wings provide stiffening. As well where the steel is doubled in the upper 20 and lower 16 flanges and the upper web portion 22 and lower web portion 14 stiffening is provided. With doubling material on the top and bottom of joist the effective web height may be shortened. As well the doubling of material provides additional capacity against web crippling for thin materials.

Figure 5:
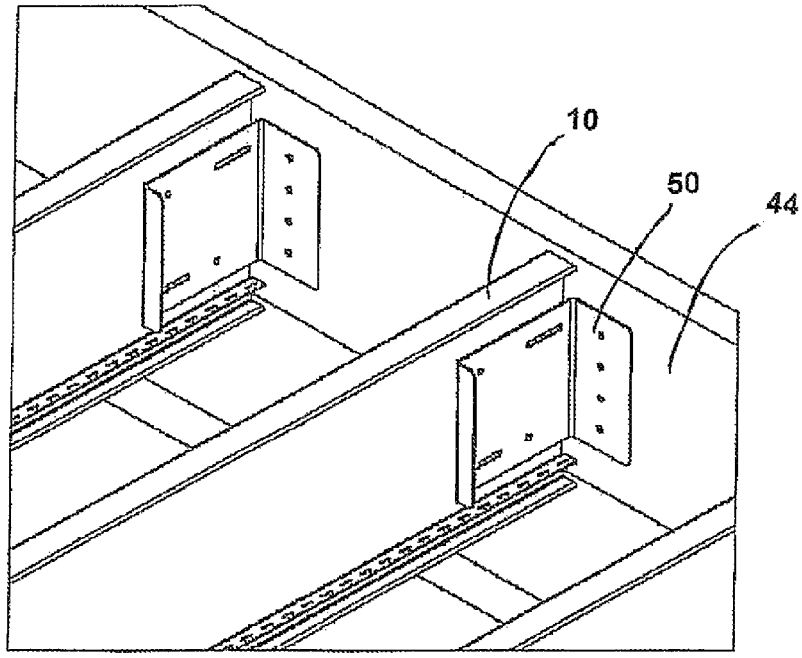
FIG. 5 is a perspective view of an embodiment of the unitary steel joist of the present invention supported by a wood header.

As shown in FIGS. 4, 5 and 11, the unitary steel joist 10 of the present invention may be positioned over centre supports 42 (FIG. 4) or supported by a wood header 44 (FIG. 5). Adjacent joists 10 may have a connector 46 to attach adjacent joists together. As well centre support connectors 48 may be used to connect joist 10 to centre supports 42. Preferably centre support connectors 48 are snap-in-place connectors connectable to the plurality of holes 34 in the wings. Adjustable connectors 50 may be used to connect joist 10 to wood headers 44.

Figure 6:
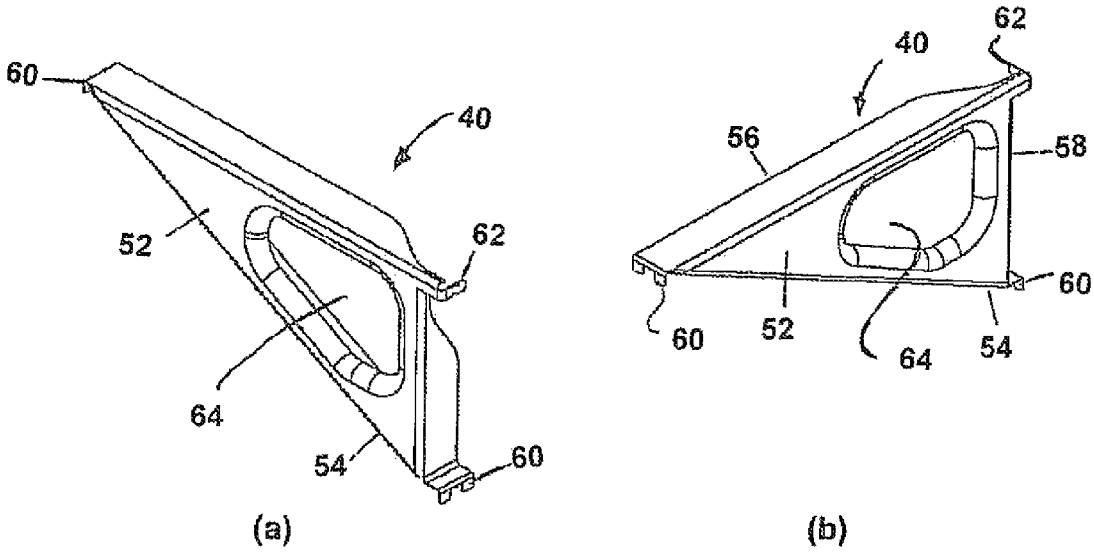
FIG. 6 (*a*) and (*b*) are perspective views of an embodiment of snap-in-place bridging for use in association with the unitary steel joist of the present invention wherein (a) shows the snap-in-place bridging looking from side and back and (b) shows the snap-in-place bridging looking from the front and side.
Figure 7:
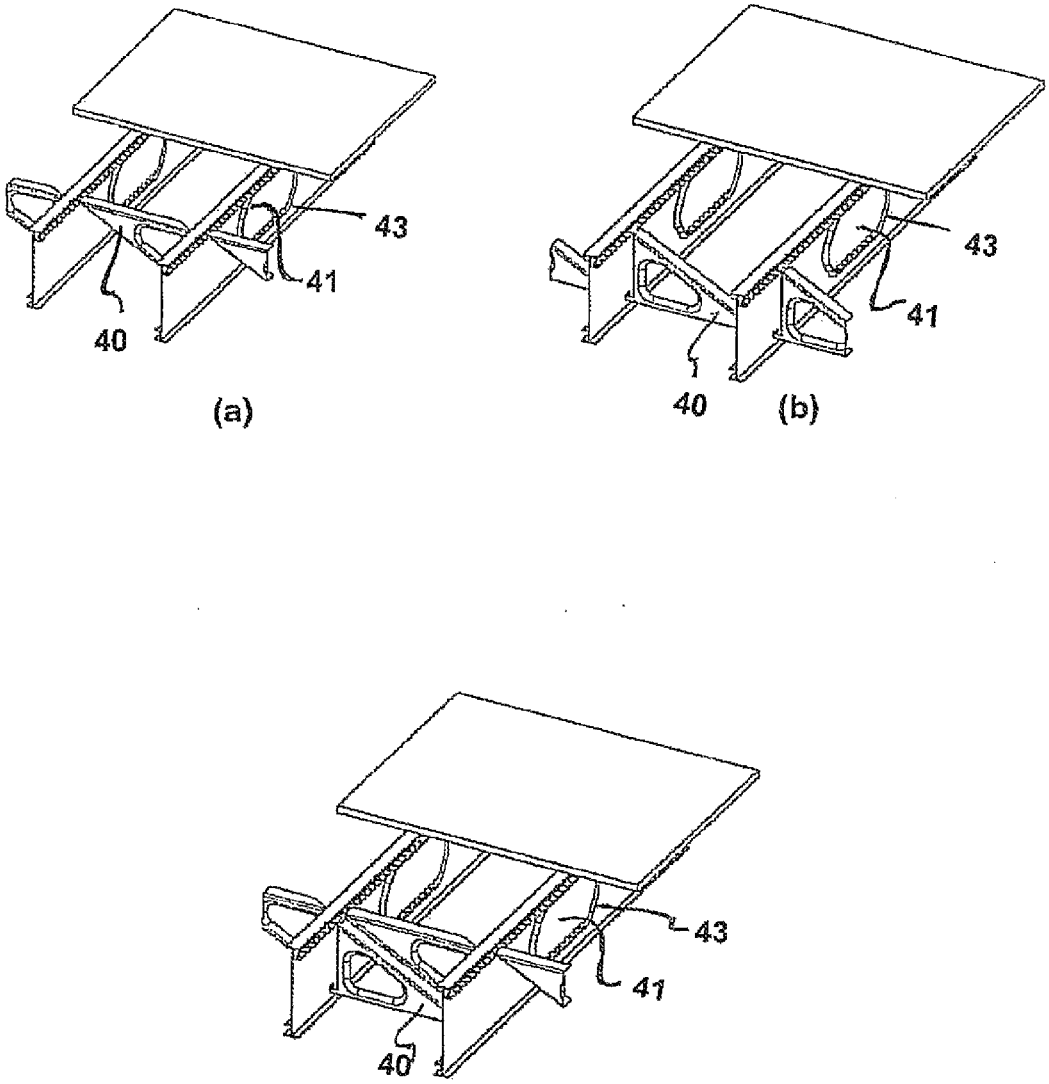
FIG. 7 (*a*) to (*b*) are perspective views of embodiments of the snap-in-place bridging of FIG. 6 shown in situ wherein (a) shows the snap-in-place bridging with the straight edge at the top; (b) shows the snap-in-place bridging with the straight edge at the bottom; and (c) shows two snap-in-place bridging installed adjacent to each other.

Joists 10 are designed to be used with snap-in-place bridging 40. Three different embodiments of snap-in-place bridging are shown herein and will be described below. Referring to FIGS. 6 and 7, snap-in-place bridging 40 includes a generally a generally triangular face 52, a generally horizontal edge portion 54 on one side thereof, an angled edge portion 56 on another side thereof, and a generally vertical edge 58 on the third side thereof. Snap-in-place teeth 60 extend from one side of the generally horizontal edge 54 and a spacing/fastener tab 62 extends from the other side thereof. As well, snap-in-place teeth extend from the generally vertical edge 58. Snap-in-place teeth 60 are adapted to be received into holes 34 in upper 24 and lower wings 12. Face 52 may have a utility hole 64 formed therein. The snap-in-place bridging 40 may be positioned such that generally horizontal edge 54 is at the top as shown in FIG. 7 (*a*) alternatively it can be positioned such that it is along the bottom as shown in FIG. 7 (*b*). As a further alternative a pair of snap in place bridging 40 may be placed adjacent to each other as shown in FIG. 7 (*c*). In this latter embodiment the two snap-in-place bridging 40 serve as structural blocking.

Figure 8:
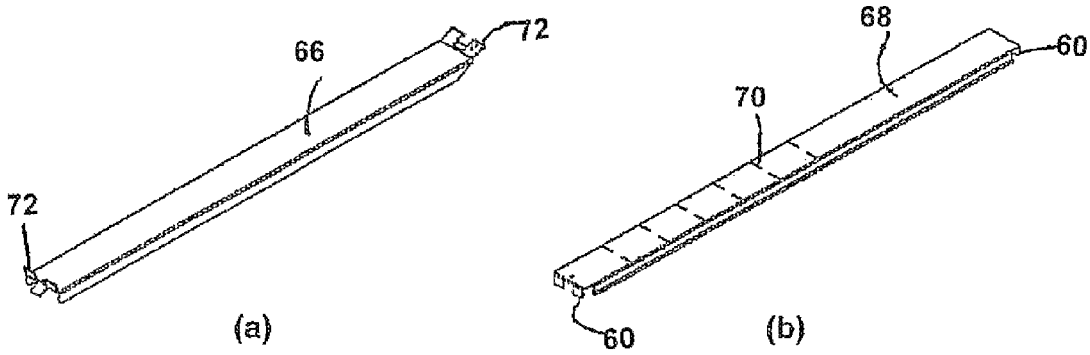
FIG. 8 (*a*) and (*b*) are perspective views of an embodiment of an adjustable snap-in-place bridging wherein (a) shows the diagonal portion and (b) shows the adjustable horizontal portion.

An alternate embodiment of snap-in-place bridging 65 is shown in FIG. 9. Snap-in-place bridging 65 includes a generally horizontal piece 68 shown in FIG. 8 (*b*) and an angled piece 66 shown in FIG. 8 (*a*). Top piece 68 has snap-in-place teeth 60 on each end thereof and a plurality of holes 70. Angled piece 66 has bridging teeth 72 on each end thereof. Bridging teeth 72 are adapted to engage the holes 34 in unitary steel joist 10 at one end thereof and holes 70 in top piece 68 at the other end thereof as shown in FIG. 9.

Figure 10:
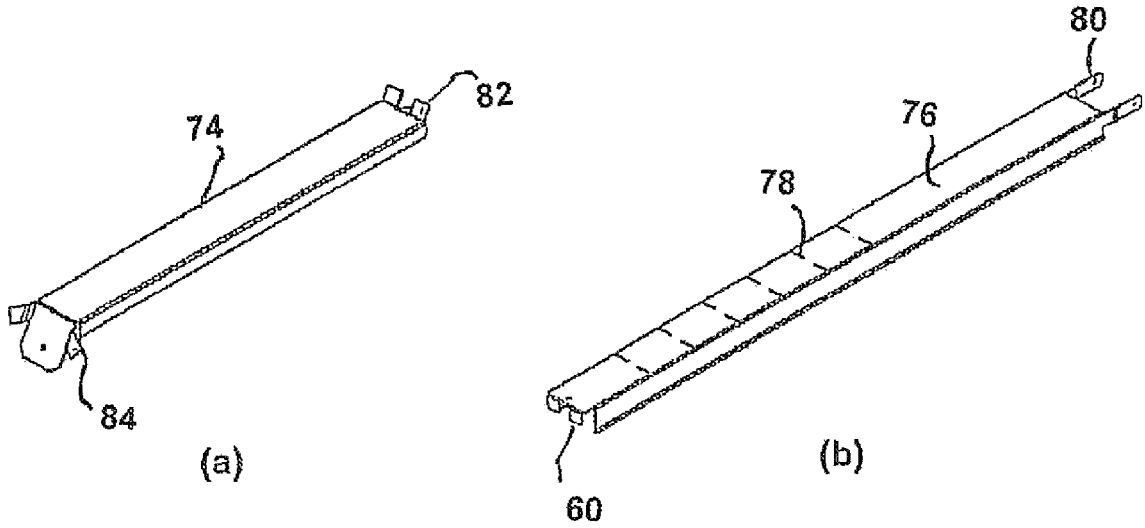
FIG. 10 (*a*) and (*b*) are perspective views of an alternate embodiment of an adjustable snap-in-place bridging wherein (a) shows the diagonal portion and (b) shows the adjustable horizontal portion.

An alternate embodiment of snap-in-place bridging 75 is shown in FIG. 11. Snap-in-place bridging 75 includes a generally horizontal piece 76 shown in FIG. 10 (*b*) and an angled piece 74 shown in FIG. 10 (*a*). Top piece 76 is similar to top piece 68 but it has snap-in-place teeth 60 on one end thereof, extensions 80 on the other end thereof and a plurality of holes 78. Angled piece 74 has top bridging teeth 82 on one end thereof and lower bridging teeth 84 on the other end thereof. Extensions 80 are adapted to extend through holes 38 in web 18 of unitary steel joist 10 on one side thereof and snap-in-place teeth 60 are adapted to engage holes 34 in wings of unitary steel joist 10. Top bridging teeth 82 are adapted to engage the holes 78 in top piece 76 and bottom bridging teeth 84 are adapted to engage holes 38 in web 18 as shown in FIG. 11.

Figure 12:
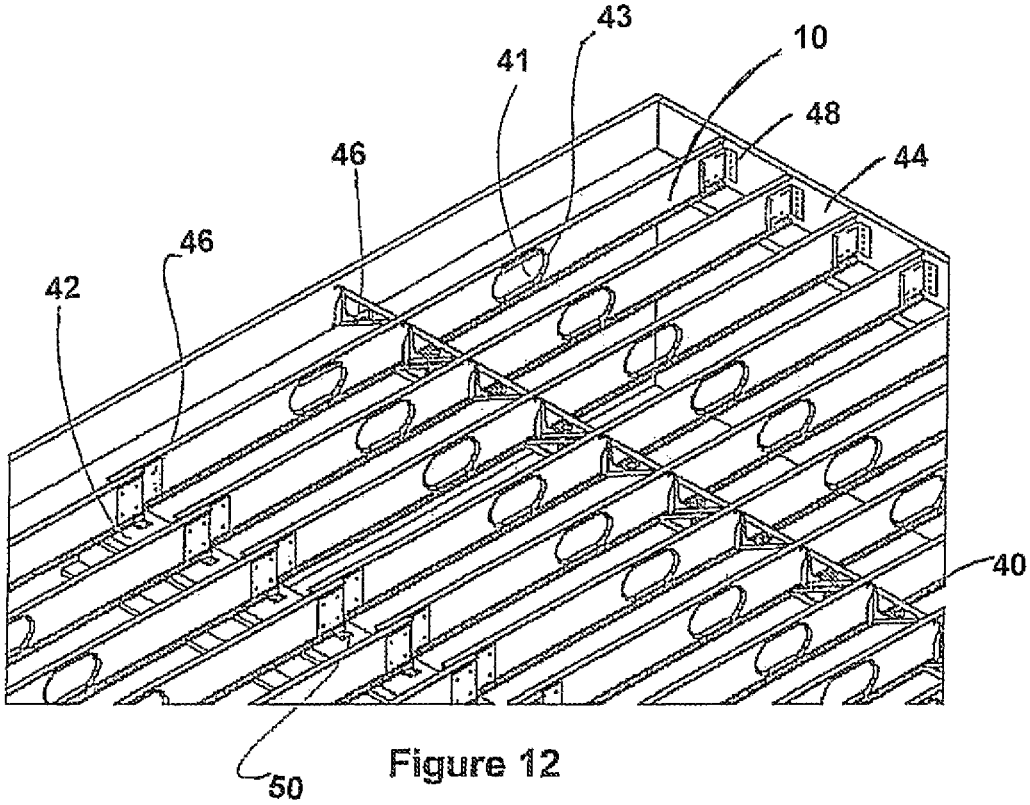
FIG. 12 is a perspective view of a plurality of unitary steel joists installed to form a floor.

As shown in FIG. 12 a plurality of unitary steel joists 10 may be used to create a floor.

The embodiments of the unitary steel joist of the present invention are made of steel to enhance fire performance. Unitary steel joist are substantially an I-Section because it is an efficient shape structurally, and the joist includes a method for snap-in bridging and modular parts so it goes together easily. This new invention provides an I-Shaped metal joist that includes modular snap-in bridging to simplify site assemble and reduce costs. It uses only a single piece of strip width for the joist section to be produced and therefore it may be cold formed into the shapes described above, so the cost to manufacture is very low.

The wings in an embodiment of the steel joist of the present invention has been developed to specifically increase the flange to web weight ratio, while shortening the effective web height. This method of building a joist allows the structural member to perform in a structurally superior manner while providing the installers with the advantage of having snap-in bridging. The method of manufacturing the new joists shown in this invention will reduce manufacture costs; the unique shape will reduce material use and simplify the site installer's work. The result is a steel floor joist system that is very competitive with I-Wood for spans of 10 ft to 22 ft. This method will also compete more efficiently in the 23 ft to 30 ft span range.

Figure 13:
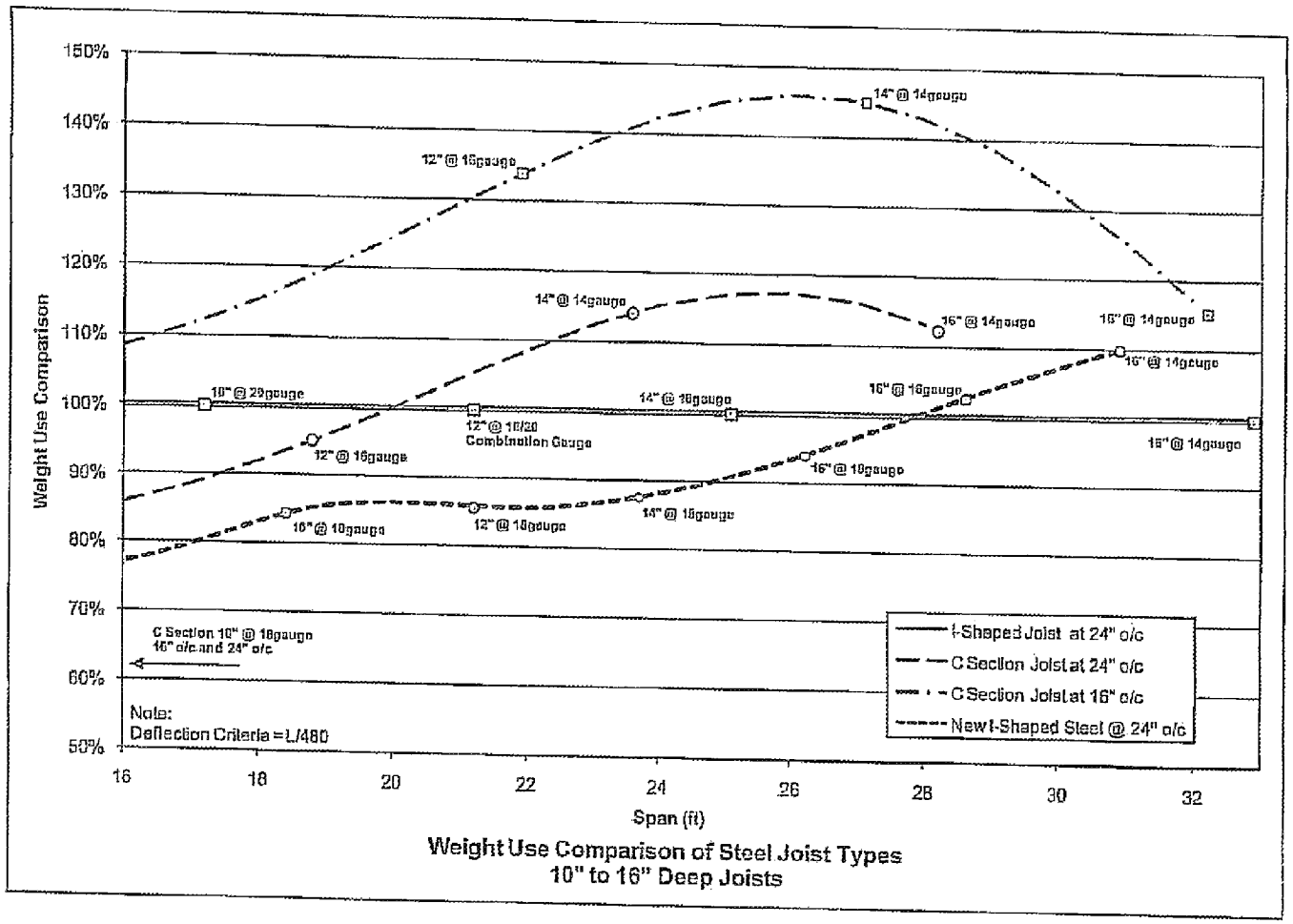
FIG. 13 is a chart showing a comparison of different joists including the new I-shaped steel joist of the present invention.

Another advantage of this invention for house framing is that an I-Shaped joist outperforms C-Shape steel joists in a strength to mass comparison, see chart shown in FIG. 13 taken from a comparative analysis of I-Shape section properties versus C-Shape section properties. The embodiments of the unitary steel joist of the present invention provide the steel industry with the opportunity to compete with the I-Wood joist market by virtue of outperforming on costing as well as fire performance.

Figure 14:
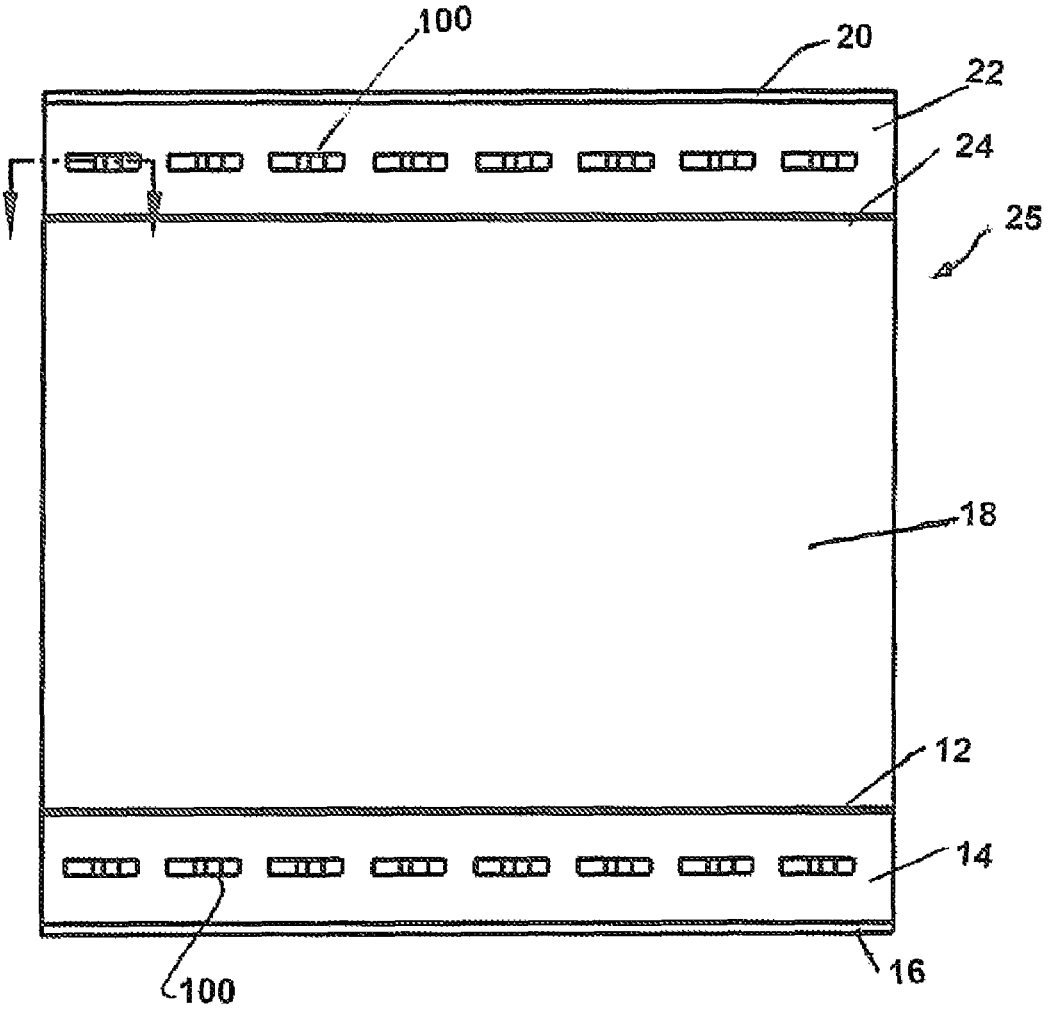
FIG. 14 is a side view of a unitary steel beam of the present invention also showing a plurality of stitching holes in the top and bottom web.
Figure 15:
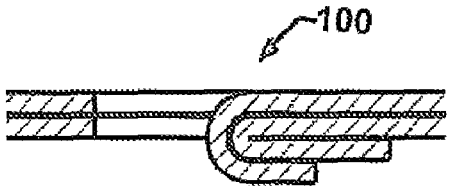
FIG. 15 is an enlarged sectional view of a stitching hole.

As shown in FIGS. 14 and 15, stitching holes 100 may be provided in the lower web portion 14 or upper web portion 22 as an alternate for attaching bridging members. Stitching holes 100 may be used in addition to or alternatively to holes 34 in the wings. Stitching holes 100 are adapted to receive bridging members. Preferably stitching holes 100 are constructed by cutting a hole in the web 18 and then folding the material back. Preferably the material is folded back on the side opposite from the unobstructed face 27 of the web 18.

Figure 16:
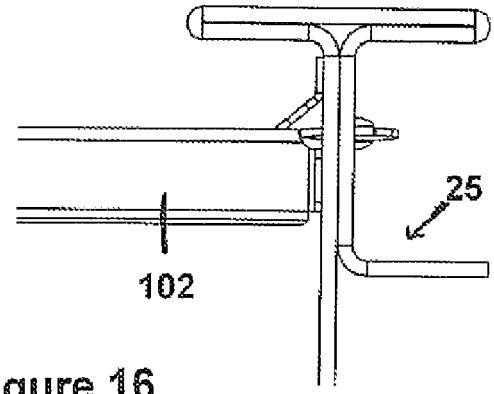
FIG. 16 is a partial sectional view of a bridging member attached to a stitching hole.
Figure 17:
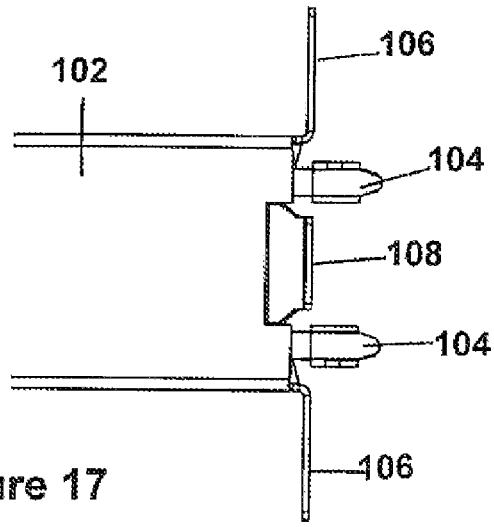
FIG. 17 is a top view of the bridging member shown in FIG. 16.
Figure 18:
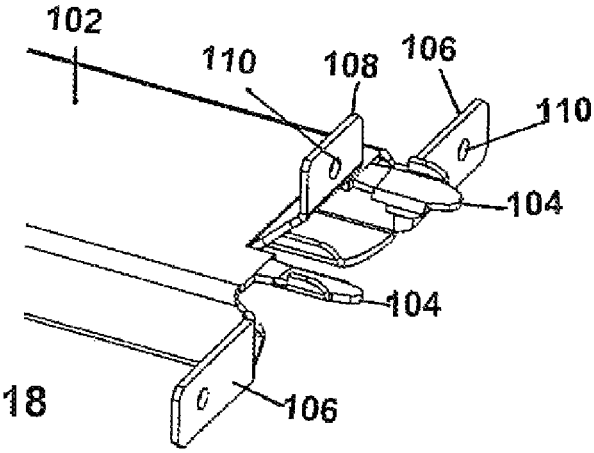
FIG. 18 is a perspective view of the bridging member shown in FIGS. 16 and 17.

Referring to FIGS. 16 to 18 an alternate bridging member 102 is shown which is for use in association with stitching holes 100. Bridging member 102 is adapted to pass through stitching holes 100. Bridging member 102 includes through tabs 104 adapted to pass through stitching holes 100. Through tabs 104 may have various configurations to provide a lock so that bridging member snaps in place. Bridging member 102 may also have side tabs 106 and an upper tab 108. Side tabs 106 and upper tab 108 may be provided with holes 110 that are adapted to receive a bolt.

Figure 19:
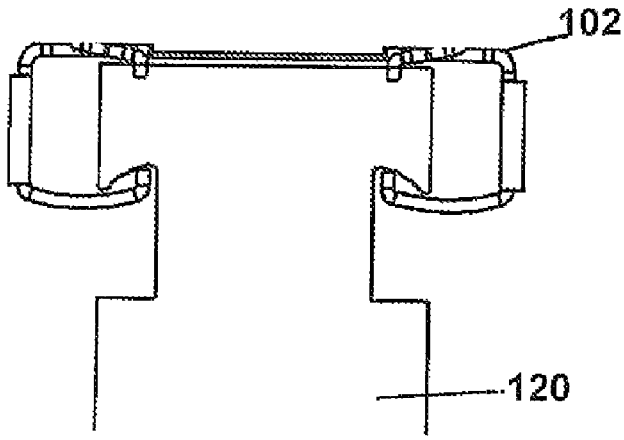
FIG. 19 is a sectional view of a bridging member with a unistrut type connectors and hanger therein.
Figure 20:
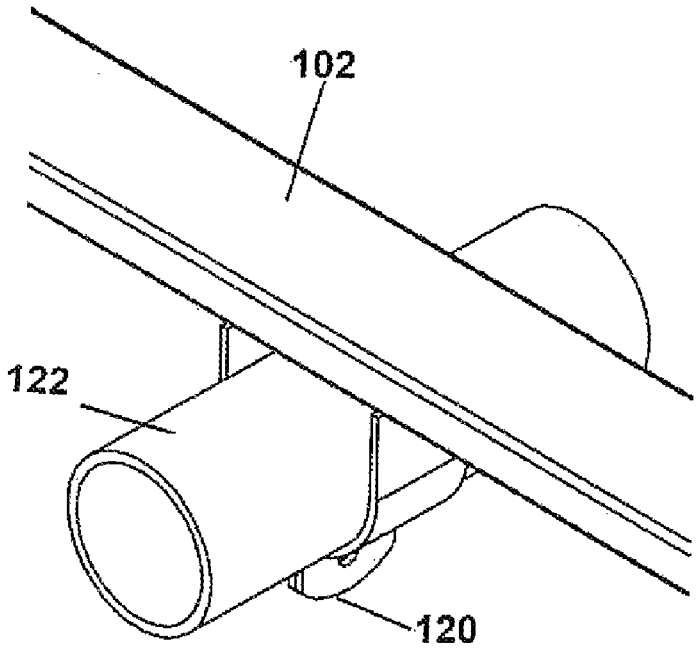
FIG. 20 is a perspective view of a bridging member with a unistrut pipe hanger and a pipe positioned therein.
Figure 21:
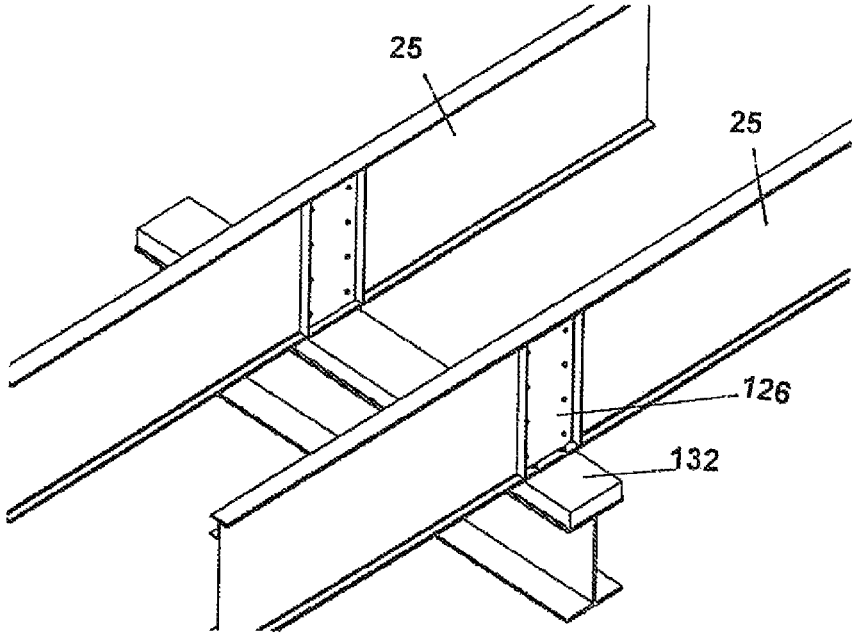
FIG. 21 is a perspective view of a joist system using an embodiment of unitary steel joist having top and bottom wings on the same side with the joists spanning over a support member with a stiffener placed in the web directly over the support member.

Referring to FIGS. 19 and 20 bridging members 102 may be used in association with unistrut members. FIG. 19 shows a Unistrut hanger 120 inserted in the bridging section 102. FIG. 20 shows a unistrut pipe hanger 120 attached to a bridging member 102. FIG. 20 shows a pipe 122 in pipe hanger 120.

Figure 23:
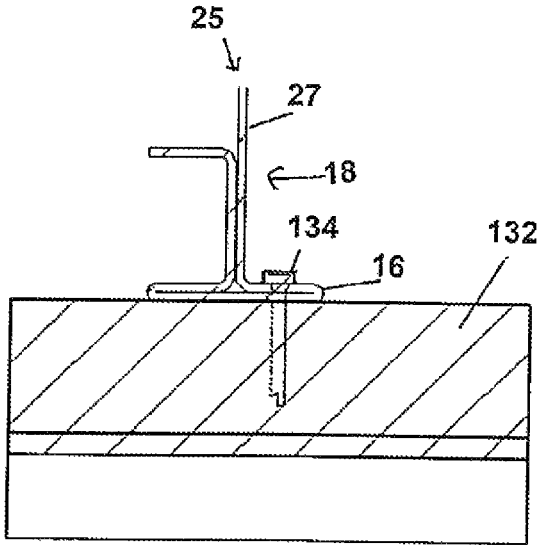
FIG. 23 is an enlarged sectional view of a unitary steel joist connected to a wood sill.
Figure 22:
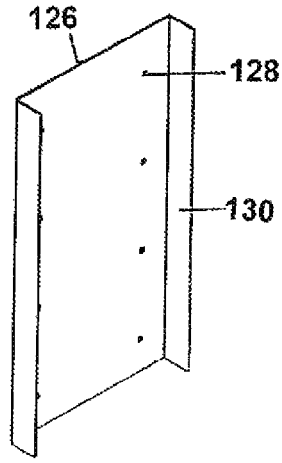
FIG. 22 is a perspective view of a web stiffener for use in the unitary steel joist shown in FIG. 21.

Referring to FIGS. 21 to 27, joist 25 is shown attached to different types of walls and supports. Unitary steel joist 25 has top 24 and bottom 12 wings on the same side of web 18. Joist 25 has an unobstructed face 27 on one side of the web 18. Unobstructed face allows for a full height web stiffener 126. Web stiffener 126 has a plurality of holes 128 formed therein. Web stiffener 126 has lips 130 formed on each side thereof. Since unitary steel joist 25 has an unobstructed face 27, there is provided access to one side of the bottom flange 16 thereby facilitating fastening to beam or wall therebelow. FIG. 23 shows unitary steel joist attached to a wood sill 132 with a fastener 134.

Figure 24:
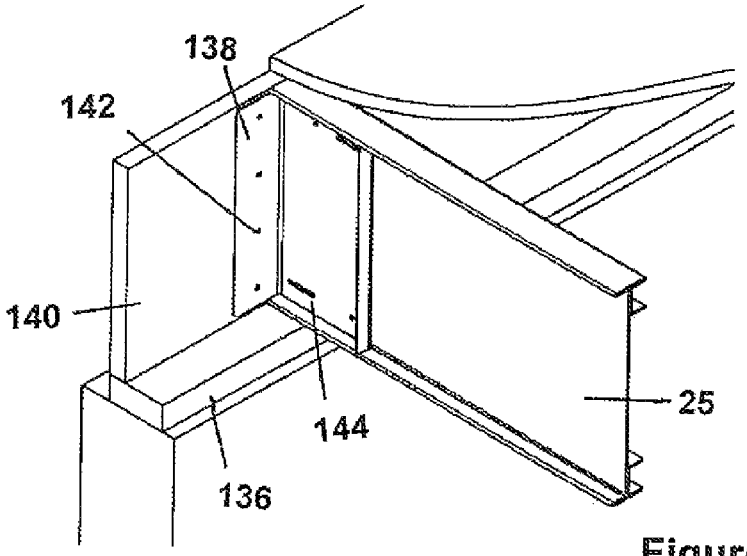
FIG. 24 is a perspective view of a joist system using an embodiment of unitary steel joist having top and bottom wings on the same side and showing squash blocking for platform framing attached to a concrete foundation wall with a wood sill and wood rim joist.
Figure 25:
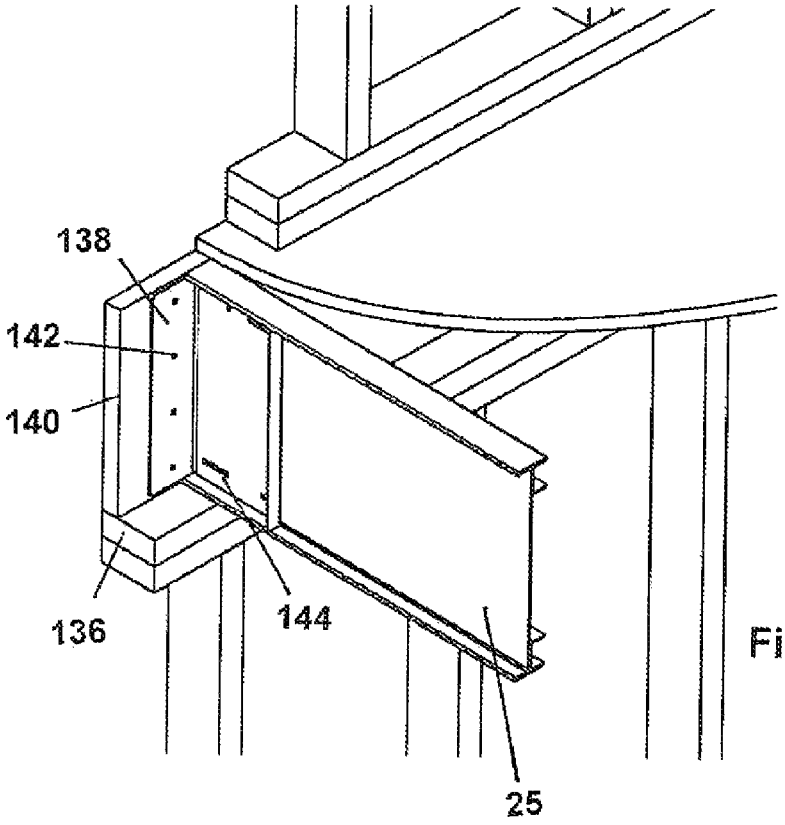
FIG. 25 is a perspective view of a joist system using an embodiment of unitary steel joist having top and bottom wings on the same side and showing squash blocking for platform framing attached to wood frame wall.
Figure 26:
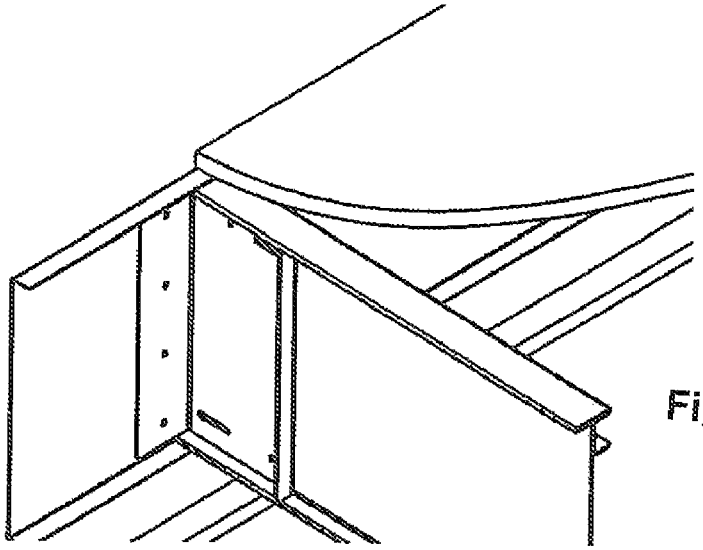
FIG. 26 is a perspective view of a joist system using an embodiment of unitary steel joist having top and bottom wings on the same side and showing squash blocking for platform framing attached to a concrete foundation wall with a wood sill and steel end track.

FIGS. 24 and 25 show a unitary steel joist 25 having top and bottom wings on the same side attached to a wall having a wood sill 136. The unobstructed face 27 of web 18 allows for squash blocking 138 for platform framing. The squash blocking is generally L-shaped having one side adapted to be attached to unitary steel beam 25 and the other side attached to vertical rim joist 140. Squash blocking 138 has a plurality of holes 142 formed therein for receiving fasteners therein. A pair of adjustment slots 144 are also formed in the squash blocking and are similarly adapted to receive fasteners.

Figure 27:
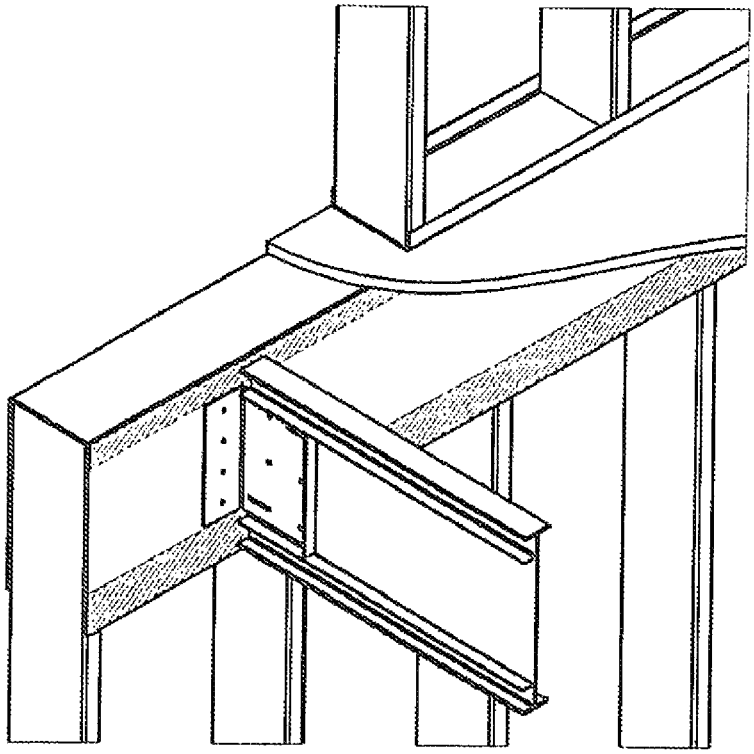
FIG. 27 is a perspective view of a joist system using an embodiment of unitary steel joist having top and bottom wings on the same side and a connector for platform framing attached to steel frame wall distribution member.
Figure 28:
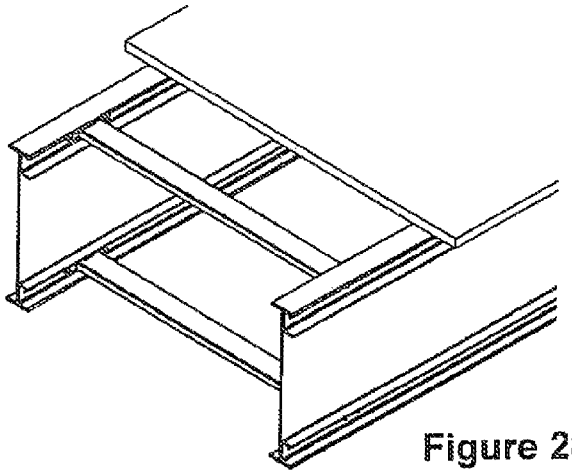
FIG. 28 is a perspective view of a joist system using an embodiment of unitary steel joist having top and bottom wings on the same side and showing an upper and lower bridging member.

FIGS. 27 and 28 show a unitary steel joist having top and bottom wings on the same side attached to a distribution member on a steel frame wall.

FIG. 28 is a perspective view of a joist system using an embodiment of unitary steel joist having top and bottom wings on the same side and showing an upper and lower bridging member.

Figure 29:
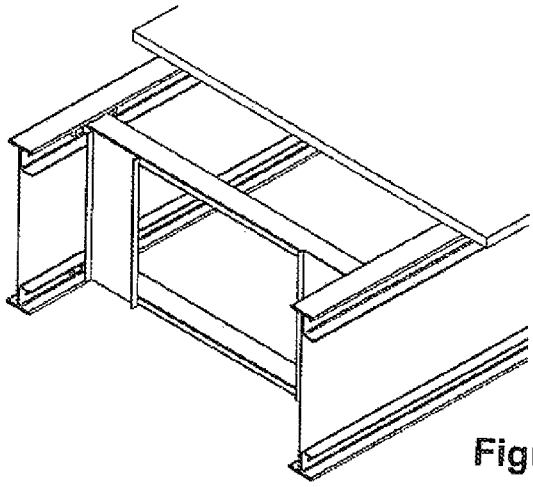
FIG. 29 is a perspective view of a joist system using an embodiment of unitary steel joist having top and bottom wings on the same side and showing an upper and lower bridging member similar to that shown in FIG. 28 but also showing partial blocking panels.

FIG. 29 is a perspective view of a joist system using an embodiment of unitary steel joist having top and bottom wings on the same side and showing an upper and lower bridging member similar to that shown in FIG. 28 but also showing partial blocking panels.

Figure 30:
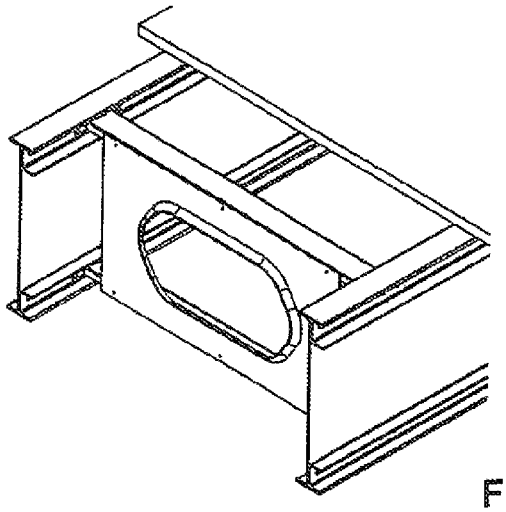
FIG. 30 is a perspective view of a joist system using an embodiment of unitary steel joist having top and bottom wings on the same side and showing a bridging member with a full blocking panel having a utility hole therein.

FIG. 30 is a perspective view of a joist system using an embodiment of unitary steel joist having top and bottom wings on the same side and showing a bridging member with a full blocking panel having a utility hole therein.

Figure 31:
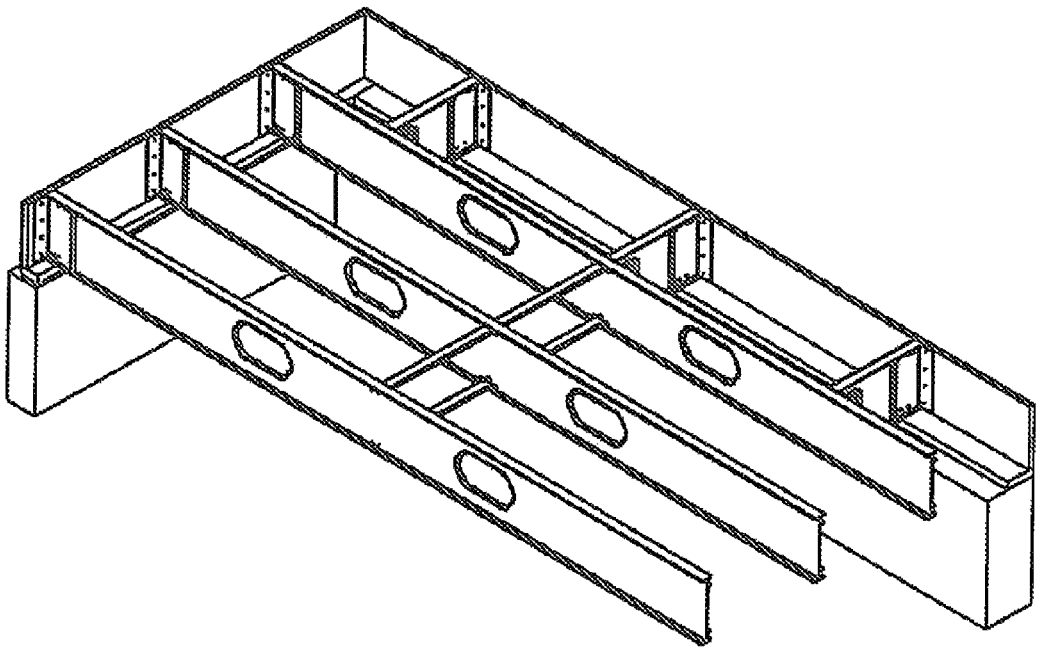
FIG. 31 is a perspective view of a joist system using a plurality of unitary steel joist having top and bottom wings on the same side and plurality of bridging members.

FIG. 31 is a perspective view of a joist system using a plurality of unitary steel joist having top and bottom wings on the same side and plurality of bridging members.

As used herein, the terms "comprises" and "comprising" are to construed as being inclusive and opened rather than exclusive. Specifically, when used in this specification including the claims, the terms "comprises" and "comprising" and variations thereof mean that the specified features, steps or components are included. The terms are not to be interpreted to exclude the presence of other features, steps or components.

What is claimed as the invention is:

1. A unitary steel joist comprising:

a generally vertical web;

a generally horizontal bottom flange extending outwardly on each side of the web, the bottom flange having a double thickness;

a generally horizontal top flange extending outwardly on each side of the web, the top flange having a double thickness;

a bottom wing extending outwardly from one side of the web;

a bottom web portion extending between the bottom flange and the bottom wing;

a top wing extending outwardly from one side of the web;

a top web portion extending between the top flange and the top wing; and whereby the web, the bottom flange, the top flange, the bottom wing, the bottom web portion, the top wing and the top web portion are made from a single continuous unitary piece of bent steel.

2. A unitary steel joist as claimed in claim 1 wherein the bottom wing and the top wing are on the same side of the web.

3. A unitary steel joist as claimed in claim 1 wherein the bottom wing and the top wing are on opposite sides of the web.

4. A unitary steel joist as claimed in claim 1 wherein the web further includes a plurality of utility holes formed therein.

5. A unitary steel joist as claimed in claim 4 wherein each utility hole has a lip around the perimeter thereof.

6. A unitary steel joist as claimed in claim 2 further including a plurality of stitching holes formed in the web.

7. A unitary steel joist as claimed in claim 6 wherein the plurality of stitching holes is positioned in one or both of:

the web between the bottom flange and the bottom wing and wherein the stitching holes also extend through the bottom web portion, and the web between the top flange and the top wing and wherein the stitching holes also extend through the top web portion.

8. A unitary steel joist as claimed in claim 3 wherein one of the bottom wing and the top wing further includes a plurality of holes formed therein.

9. A unitary steel joist as claimed in claim 3 wherein both the top wing and the bottom wing further include a plurality of holes formed therein.

10. A unitary steel joist as claimed in claim 8 wherein the unitary steel joist is a first steel joist and further including a plurality of steel joists to form a steel floor.

11. A unitary steel joist as claimed in claim 10 further including snap-in-place bridging and the snap-in-place bridging is adapted to engage the holes in the wings and is adapted to be positioned between adjacent unitary steel joists.

12. A unitary steel joist as claimed in claim 11 wherein the snap-in-place bridging has a generally triangular face, a generally horizontal edge portion on one side thereof, an angled edge portion on another side thereof and a generally vertical portion on the third side thereof.

13. A unitary steel joist as claimed in claim 11 wherein the snap-in-place bridging includes a first generally horizontal piece and an angled piece.

14. A unitary steel joist as claimed in claim 13 wherein the generally horizontal piece extends between two adjacent unitary steel joists and engages the holes formed in the upper wings of the adjacent unitary steel joists.

15. A unitary steel joist as claimed in claim 13 wherein the generally horizontal piece further includes a plurality of holes formed therein and the angled piece engages the holes in the generally horizontal piece on one side thereof and engages the holes in the wings of the unitary steel joist on the other side thereof.

16. A unitary steel joist as claimed in claim 13 wherein each web of the unitary steel joist includes a plurality of holes in the bottom and the top thereof proximate to the upper and lower wings and wherein one side of the generally horizontal piece engages the holes in the web and the other side engages the holes in the wings.

17. A unitary steel joist as claimed in claim 13 wherein the generally horizontal piece further includes a plurality of holes formed therein and the angled piece engages the holes in the generally horizontal piece on one side thereof and engages the holes in the web of the unitary steel joist on the other side thereof.

18. A unitary steel joist as claimed in claim 7 wherein the unitary steel joist is a first steel joist and further including a plurality of steel joists to form a steel floor.

19. A unitary steel joist as claimed in claim 18 further including bridging members wherein each bridging member is adapted to be received in the stitching holes and to span between adjacent unitary steel joists.

20. A unitary steel joist as claimed in claim 19 wherein each bridging member includes a through tab adapted to extend through the stitching hole.

21. A unitary steel joist as claimed in claim 20 wherein each bridging member further includes one of side tabs, upper tab and a combination of side tabs and upper tab.

22. A unitary steel joist as claimed in claim 19 further including a unistrut pipe hanger attached to the bridging member.

23. A unitary steel joist as claimed in claim 19 wherein the bridging member is an upper bridging member and further including a lower bridging member attached between adjacent unitary steel joists and spaced downwardly from the upper bridging member.

24. A unitary steel joist as claimed in claim 23 further including at least one partial blocking panel extending between the upper and lower bridging members.

25. A unitary steel joist as claimed in claim 19 wherein the bridging member includes a full blocking panel.

26. A unitary steel joist as claimed in claim 25 wherein the full blocking panel has a utility hole formed therein.

27. A unitary steel joist as claimed in claim 19 further including a squash blocking.

* * * * *